US005969592A

United States Patent [19]

Reed

[11] Patent Number: 5,969,592

[45] Date of Patent: Oct. 19, 1999

[54] AUDIO BEVERAGE COVER

[76] Inventor: D. C. Reed, P.O. Box 3197, Grapevine, Tex. 76099

[21] Appl. No.: 08/902,405

[22] Filed: Jul. 29, 1997

[51] Int. Cl.[6] ..... G08B 3/00

[52] U.S. Cl. ..... 340/384.1; 340/384.7; 340/693.5; 340/693.11; 340/692; 220/739; 220/737; 220/903; 206/459.1

[58] Field of Search ..... 340/384.1, 384.7, 340/328, 692, 691, 693; 220/739, 902, 903, 737; 206/459.1; 62/457.2

[56] References Cited

U.S. PATENT DOCUMENTS

| | | | |
|---|---|---|---|
| 4,793,149 | 12/1988 | Riche | 62/293 |
| 4,883,205 | 11/1989 | Saelens et al. | 220/739 |
| 4,886,183 | 12/1989 | Fleming | 220/739 |
| 5,070,539 | 12/1991 | Cheng | 220/737 |
| 5,130,696 | 7/1992 | Liebman | 340/384.71 |
| 5,147,067 | 9/1992 | Effertz | 220/739 |
| 5,152,709 | 10/1992 | Johnson, III et al. | 220/739 |
| 5,235,822 | 8/1993 | Leonovich, Jr. | 62/457.2 |
| 5,464,092 | 11/1995 | Seeley | 340/384.7 |
| 5,536,196 | 7/1996 | Sternberg | 215/400 |
| 5,575,383 | 11/1996 | Seeley | 340/384.7 |

*Primary Examiner*—Jeffery A. Hofsass
*Assistant Examiner*—Sihong Huang
*Attorney, Agent, or Firm*—Dan Venglarik

[57] ABSTRACT

A beverage cover includes an insulating sleeve receiving an insert and supporting a sound generating device. The sound generating device is protected from moisture such as condensation and the like, is selectively operable, and may contain a melody or other preprogrammed audio track. The beverage container may thus be used for amusement or entertainment as well as to reinforce promotional messages associated with distribution of the beverage cover.

13 Claims, 3 Drawing Sheets

AUDIO BEVERAGE COVER

BACKGROUND OF THE INVENTION

1. Technical Field

The present invention relates generally to beverage covers and in particular to beverage covers distributed as part of promotional efforts. Still more particularly, the present invention relates to a distinctive and memorable beverage cover which may be distributed as part of a promotional effort to reinforce the promotional message while providing recipients with a source of amusement.

2. Description of the Related Art

Beverage covers, particularly those comprising an insulating sleeve of the type generally referred to a "coozies" or "Koozies," are frequently distributed as part of promotional efforts for concerts, sporting events, movies, radio stations, and other aspects of the entertainment industry. The practice has become so common, however, and beverage covers so widely available for small costs, that the distinctiveness of the beverage covers as a promotional item has been lost. Retention of the promotional message relating to the beverage covers is thus substantially reduced.

It would be desirable, therefore, to provide a distinctive beverage cover which reinforces retention of a promotional message when distributed. It would further be advantageous if the beverage cover provided a source of amusement or entertainment to recipients.

SUMMARY OF THE INVENTION

A beverage cover includes an insulating sleeve receiving an insert and supporting a sound generating device. The sound generating device is protected from moisture such as condensation and the like, is selectively operable, and may contain a melody or other preprogrammed audio track. The beverage container may thus be used for amusement or entertainment as well as to reinforce promotional messages associated with distribution of the beverage cover.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION

Figure 1:
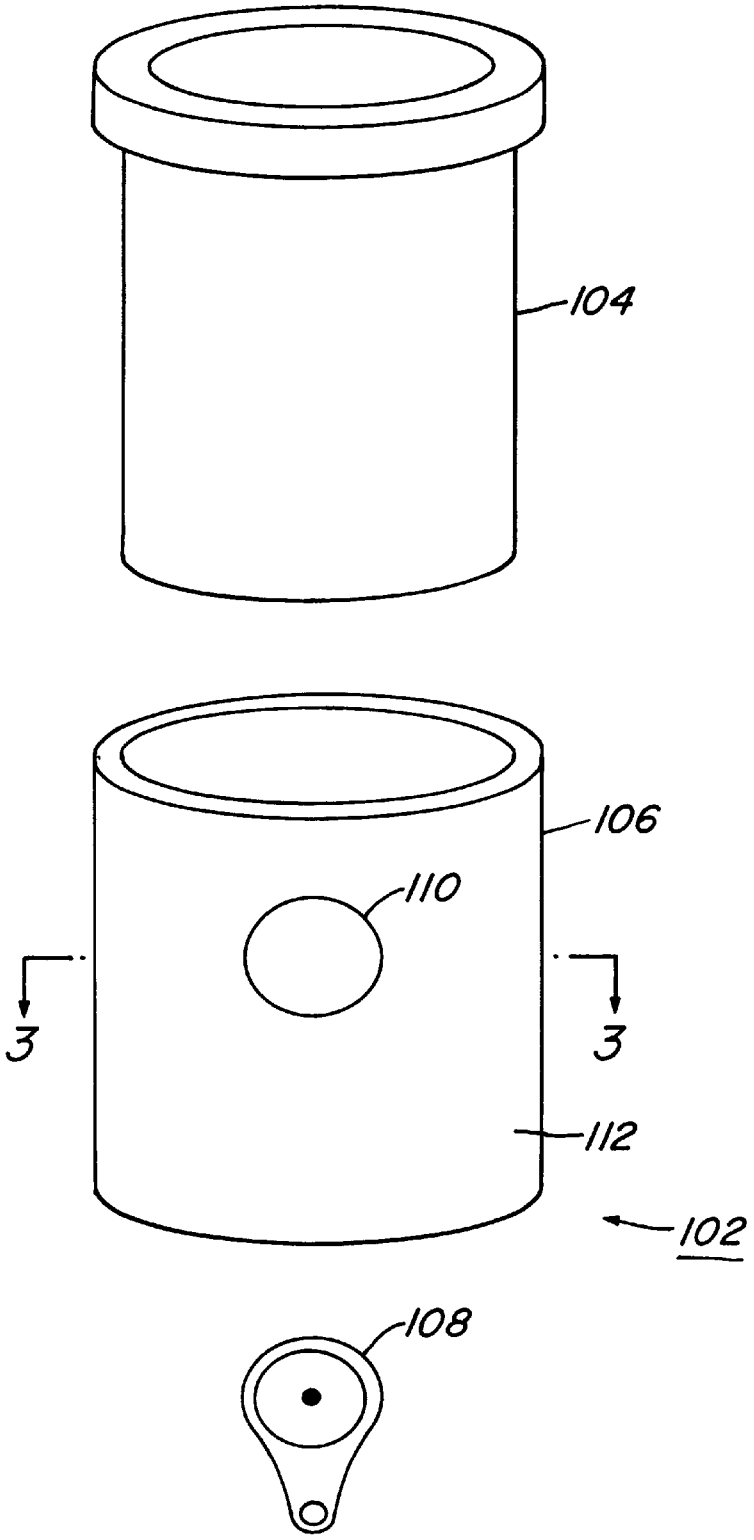
FIG. 1 depicts an exploded pictorial representation of a musical beverage cover in accordance with a preferred embodiment of the present invention.

With reference now to the figures, and in particular with reference to FIG. 1, an exploded pictorial representation of a musical beverage cover in accordance with a preferred embodiment of the present invention is depicted. Musical beverage cover 102 includes an insert 104, an insulating sleeve 106 capable of receiving insert 104, and a sound generating device 108 affixed to insulating sleeve 106 and/or insert 104. Unlike conventional insulating sleeves employed as beverage covers, insulating sleeve 106 is adapted to include a hole/recess 110 on a peripheral portion 112 for receiving sound generating device 108. While the prior art occasionally provides a drain hole in a bottom portion of an insulating sleeve utilized as a beverage cover, holes and/or recesses on peripheral portion of an insulating sleeve increase manufacturing complexity and costs. Since the principle benefit of insulating sleeves as beverage covers derives from their ease and economy in fabrication, such recesses or holes are not typically provided in a peripheral portion in known commercial embodiments.

When assembled, beverage cover 102 is capable of receiving and keeping cool a beverage container such as a standard aluminum can (not shown). Sound generating device 108, protected from moisture deriving from condensation and/or spilled beverage, may be actuated by the user to generate a melody or other preprogrammed audio track. Sound generating device 108 may be affixed to insulating sleeve 106 using a moisture-proof adhesive, or may be retained between insulating sleeve 106 and insert 104 when insert 104 is sized for a friction fit within insulating sleeve 106.

Figure 2:
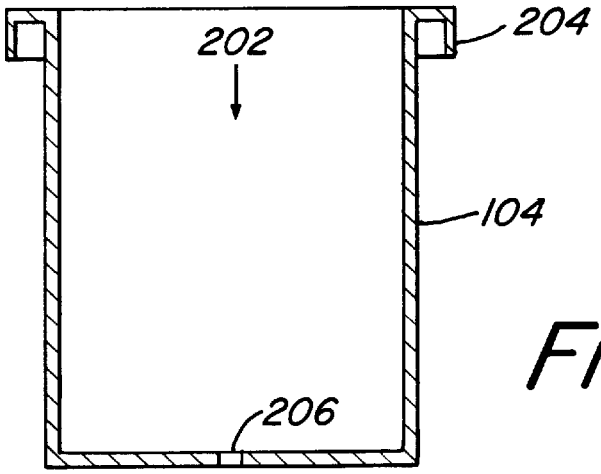
FIG. 2 is a cross-sectional view of an insert for a musical beverage cover in accordance with a preferred embodiment of the present invention.

Referring to FIG. 2, a cross-sectional view of an insert for a musical beverage cover in accordance with a preferred embodiment of the present invention is illustrated. Insert 104 is an optional component, which need not be incorporated within a beverage cover in accordance with the present invention. However, insert 104 facilitates receiving a beverage container such as an aluminum can, protecting sound generating device 108 from undue stress arising from forced insert of a beverage container. Insert 104 also contributes to the protection of sound generating device 108 from moisture.

Insert 104 may be a rigid plastic structure formed by injection molding using methods known in the art. Insert 104 is essentially annular, forming an enclosed cylindrical cavity 202 for receiving a beverage container. Cavity 202 may be approximately 4 to 5 inches deep. An upper lip 204 of insert 104 may be folded over to form an annular cavity for receiving a top portion of insulating sleeve 106. The bottom of insert 104 may include a drain hole 206. Insert 104 of the exemplary embodiment has an overall length of approximately four inches, with a diameter at the region of lip 204 of about 3½ inches and a diameter at other regions of between approximately 2⅝ to 2¾ inches. The diameter of the main body of insert 104, at regions other than that including lip 204, may be varied to achieved a desired friction fit within a standard sized insulating sleeve employed as a beverage cover.

Figure 3A:
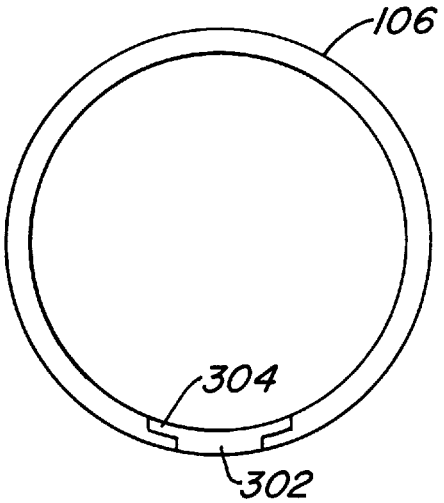
FIGS. 3A–3C depict cross-sectional views of alternative embodiments of an insulating sleeve for a musical beverage cover in accordance with a preferred embodiment of the present invention.
Figure 3B:
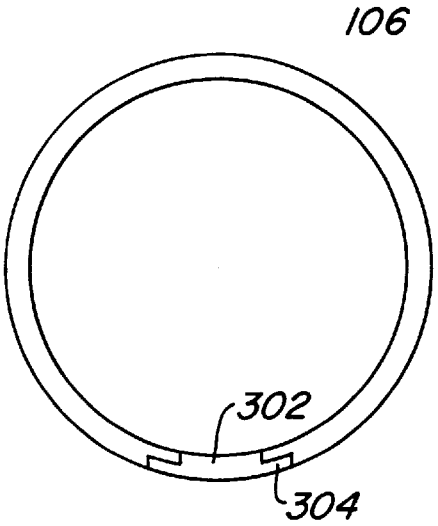
Figure 3C:
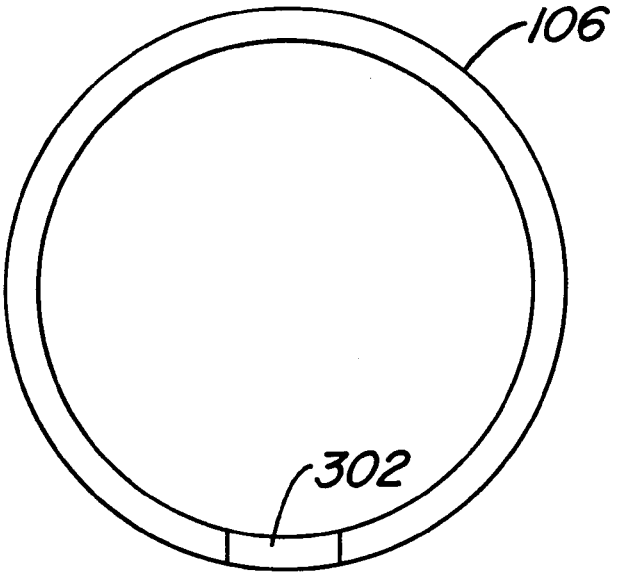

With reference now to FIGS. 3A–3C, cross-sectional views of alternative embodiments of an insulating sleeve for a musical beverage cover in accordance with a preferred embodiment of the present invention are depicted. Insulating sleeve 106 is conventionally formed of a foam material and include a peripheral portion and, optionally, a bottom portion. The cross-sectional views depicted in FIGS. 3A–3C are taken at section lines A—A depicted in FIG. 1.

In a first embodiment, depicted in FIG. 3A, insulating sleeve 106 includes a combined hole 302 and recess 304 in a peripheral portion of insulating sleeve 106. As depicted, recess 304 overlaps hole 302 and is situated on an inner surface of insulating sleeve 106. In this embodiment, sound generating device 108 may be disposed within recess 304 when the beverage cover is assembled. A moisture proof adhesive may be employed to facilitate retention of sound generating device 108 within recess 304. Hole 302 is necessary to allow sound emanating from sound generating device 108 to be transmitted through an air interface at an audible level for the user. Recess 304 may be sized so that insulating sleeve 106 does not exhibit an excessive protrusion in the area of sound generating device 108 when the beverage cover is assembled.

An alternative embodiment, depicted in FIG. 3B, also includes hole 302 and recess 304. In this embodiment, however, recess 304 overlaps hole 302 but is situated on an outer surface of insulating sleeve 106. Sound generating device 108 is inserted into recess 304 and retained by a moisture-proof adhesive. Hole 302 is not required but may be desirable to receive portions of sound generating device 108 so that sound generating device 108 does not protrude excessively from the surface of insulating sleeve 106 when the beverage cover is assembled. In embodiments where hole 302 is not required, the intervention of a portion of insulating sleeve 106 between sound generating device 108 and insert 102 and/or a beverage container contributes to the protection of sound generating device 108 from condensation-type moisture.

A third alternative embodiment, depicted in FIG. 3C, simply provides hole 302 through insulating sleeve 106. In this embodiment, sound generating device 108 may be affixed to either an internal or external surface of insulating sleeve 106, although noticeable protrusion of the insulating sleeve 106 in the area of sound generating device 108 is likely to result.

Figure 4:
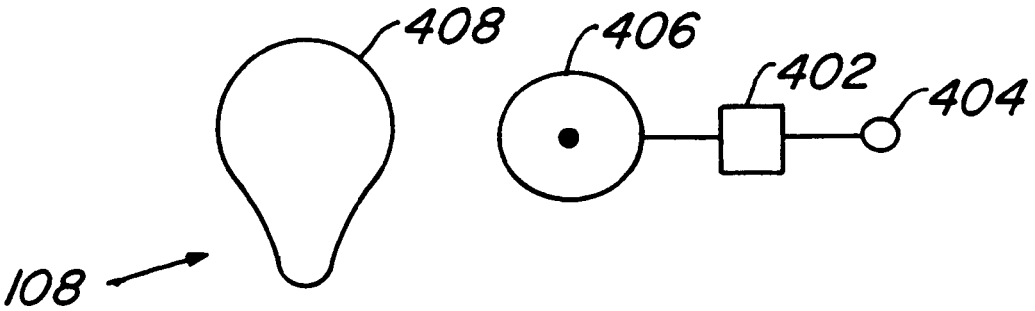
FIG. 4 is a diagram of a sound generating device for a musical beverage cover in accordance with a preferred embodiment of the present invention.

Referring to FIG. 4, a diagram of a sound generating device for a musical beverage cover in accordance with a preferred embodiment of the present invention is illustrated. In the exemplary embodiment, sound generating device 108 includes a read-only memory (ROM) circuit module 402 of the type known in the art and available from Intel Corporation and/or other commercial sources. Circuit module 402 contains a preprogrammed audio track and outputs signals for playing this track when powered. Circuit module 402 may be powered by a button cell battery 404 with a switch intrinsically formed into the support for electrically connecting battery 404 to circuit module 402. Circuit module 402 is also connected to Piezo audio transducer 406 which generates sounds from signals received from circuit module 402. Flexible plastic cover 408 may be employed to encapsulate the other components of sound generating device 108 to protect them from moisture and to facilitate fastening of sound generating device 108 to insulating sleeve 106. Alternatively, transducer 406 may be affixed to the outside of plastic cover 408 within the electrical connection to circuit module 402 made through a hole (not shown) in plastic cover 408 and moisture-proof adhesive forming a seal between transducer 406 and plastic cover 408.

Sound generating device 108 may be formed as a separate unit before being affixed to insulating sleeve 106 and/or insert 104. Any suitable audio track may be preprogrammed into sound generating device 108 such as a school fight song, an advertising jingle, a sports-related melody such as Take Me Out To the Ballpark, or a portion from a song from a movie. The audio track need not be musical, but may be any sequence of sounds employed to promote products or services to consumers.

The present invention allows beverage covers distributed as part of promotional efforts to be distinctive and memorable to recipients. The beverage cover of the present invention also provides a source of amusement or entertainment to the user.

The description of the preferred embodiment of the present invention has been presented for purposes of illustration and description, but is not intended to be exhaustive or limit the invention in the form disclosed. Many modifications and variations will be apparent to those of ordinary skill in the art. The embodiment was chosen and described in order to best explain the principles of the invention and the practical application to enable others of ordinary skill in the art to understand the invention for various embodiments with various modifications as are suited to the particular use contemplated.

What is claimed is:

1. An apparatus for retaining a beverage container comprising:

a sleeve, the sleeve having a cylindrical cavity adapted to receive the beverage container, wherein the sleeve is formed from an insulating material; and a sound generating device encapsulated within a moisture-proof cover coupled to the sleeve such that a speaker within the sound generating device is aligned with a hole through the sleeve, wherein the sound generating device is operable to generate preselected sounds.

2. The apparatus of claim 1, wherein the cylindrical cavity has a length from about 4 inches to about 5 inches.

3. The apparatus of claim 2, wherein the cylindrical cavity has a diameter from about 2⅝ inches to about 2¾ inches.

4. The apparatus of claim 1, wherein the insulating sleeve is formed from foam.

5. An apparatus for retaining a beverage container comprising:

an insert, the insert having a first end and a second end, the first end having an opening in communication with a cylindrical cavity, wherein the opening is configured to allow placement of the beverage container into the cylindrical cavity;

an insulating sleeve, the insulating sleeve having a first end and a second end, the first end of the insulating sleeve having an opening in communication with a cylindrical cavity configured to receive the insert; and an electronic sound generating device encapsulated within a moisture-proof cover attached to the insulating sleeve with a speaker in the sound generating device aligned with a hole through the sleeve.

6. The apparatus of claim 5, wherein the opening in the first end of the insert has a lip configured to be folded over to form an annular cavity for receiving the first end of the insulating sleeve.

7. The apparatus of claim 5, wherein the cylindrical cavity in the sleeve has a length from about 4 inches to about 5 inches.

8. The apparatus of claim 7, wherein the cylindrical cavity in the sleeve has a diameter from about 2⅝ inches to about 2¾ inches.

9. The apparatus of claim 5, wherein the insulating sleeve includes a recess overlapping the hole configured to receive and hold the electronic sound generating device.

10. The apparatus of claim 9, wherein the recess is configured to receive and hold the electronic sound generating device between the sleeve and the insert.

11. The apparatus of claims 9, wherein the sleeve has an outer surface and the recess is located on the outer surface.

12. The apparats of claim 5, wherein the second end of the insert has a drain hole.

13. The apparatus of claim 5, wherein the electronic sound generating device comprises:

a circuit module, the circuit module including a data for preselected sound and generating signals in response to application of power to the circuit module;

a battery unit including a switch, wherein the battery unit is coupled to the circuit module, wherein the battery unit is operable to provide power to the circuit module; and an audio transducer coupled to the circuit module, wherein the audio transducer generates the preselected sound in response to signals from the circuit module.

* * * * *